United States Patent [19]

Westervelt et al.

[11] Patent Number: 4,554,730

[45] Date of Patent: Nov. 26, 1985

[54] METHOD OF MAKING A VOID-FREE NON-CELLULOSE ELECTRICAL WINDING

[75] Inventors: Dean C. Westervelt, Acme; Thomas M. Burke, Whitehall, both of Pa.

[73] Assignee: Westinghouse Electric Corp., Pittsburgh, Pa.

[21] Appl. No.: 569,069

[22] Filed: Jan. 9, 1984

[51] Int. Cl.[4] ..... H01F 3/06

[52] U.S. Cl. ..... 29/605; 336/205; 427/116; 427/118

[58] Field of Search ..... 29/605; 336/205, 206; 427/116–118, 120, 420

[56] References Cited

U.S. PATENT DOCUMENTS

| | | | |
|---|---|---|---|
| 762,111 | 6/1904 | Apple | 336/ |
| 1,317,002 | 9/1919 | Creighton | 336/205 |
| 1,579,883 | 4/1926 | Murray | 336/205 |
| 1,777,571 | 10/1930 | McCullough | 29/605 |
| 1,932,640 | 10/1933 | Rust | 29/605 |
| 2,328,443 | 8/1943 | Foster . | |
| 2,352,166 | 6/1944 | Camilli | 336/206 |
| 2,381,782 | 8/1945 | Stephens . | |
| 2,739,371 | 3/1956 | Grisdale et al. | 29/605 |
| 3,477,126 | 11/1969 | Price | 29/25.42 |
| 3,963,882 | 2/1976 | Lewis | 29/594 |
| 4,038,741 | 8/1977 | Schuler | 29/605 |
| 4,095,557 | 6/1978 | Croop et al. | 29/605 |
| 4,403,404 | 9/1983 | Westervelt | 29/605 |
| 4,406,056 | 9/1983 | Buckley et al. | 29/605 |

FOREIGN PATENT DOCUMENTS

| | | |
|---|---|---|
| 778939 | 2/1968 | Canada . |
| 55-26653 | 2/1980 | Japan . |
| 264685 | 1/1927 | United Kingdom . |

*Primary Examiner*—Howard N. Goldberg
*Assistant Examiner*—P. W. Echols
*Attorney, Agent, or Firm*—D. R. Lackey

[57] ABSTRACT

Methods of constructing a void-free, cellulose-free electrical winding insulated with a solid resinous insulation. The method includes forming a plurality of conductor turns on a substrate, with each conductor turn being immersed in liquid resinous insulation as it is formed, to provide a void-free intermediate structure. The void-free aspect of the intermediate structure is maintained up to and including the final step of the method by building solid insulation, thin layer upon thin layer, from the liquid resinous insulation, while the conductor turns are being formed, with the solid insulation, as it is formed, providing a solid substrate for the continued application of liquid resinous insulation and subsequent conductor turns of the winding.

17 Claims, 6 Drawing Figures

METHOD OF MAKING A VOID-FREE NON-CELLULOSE ELECTRICAL WINDING

BACKGROUND OF THE INVENTION

1. Field of the Invention

The invention relates in general to electrical windings, and more specifically to new and improved methods for constructing electrical windings.

2. Description of the Prior Art

In many conventional windings, such as transformer windings, the various winding or turn layers are supported and electrically insulated from one another by cellulosic insulation, such as paper immersed in oil. Other conventional winding structures employ non-cellulosic insulating material, such as cast resin, to provide conductor support and insulation. Cellulose-free windings have certain advantages over those which use cellulose, such as being more resistant to short circuit stresses, moisture degradation, mechanical vibration, and fire, and less susceptible of out-gassing and thermal aging. Unfortunately, cellulose-free windings of conventional design also have certain disadvantages, including a relatively high cost in terms of both manufacture and loadability, and the difficulty of ridding them of shrinkage voids.

Applications Ser. No. 264,151, filed May 15, 1981, now abandoned, Ser. No. 524,227, filed Aug. 18, 1983, which is a continuation of abandoned application Ser. No. 264,151, Ser. No. 308,314, filed Oct. 2, 1981, now U.S. Pat. No. 4,403,404, Ser. No. 308,315, filed Oct. 13, 1981, now U.S. Pat. No. 4,406,056 and Ser. No. 409,681, filed Aug. 19, 1982, now abandoned, all of which are assigned to the same assignee as the present application, disclose new and improved cellulose-free winding structures, and methods of constructing such windings, which reduce the manufacturing cost and which control the formation and size of voids in the winding structure, such as those due to polymerization shrinkage. These patent applications are all based on the concept of constructing an electrical winding in a substantially continuous operation, including the steps of applying liquid resinous insulation to a substrate, quickly solidifying the liquid resin, and immediately applying one or more conductor turns to the just solidified resin.

SUMMARY OF THE INVENTION

Briefly, the present invention relates to new and improved methods of constructing electrical windings, which methods may be used with, or in place of, certain of the methods disclosed in the hereinbefore-mentioned, commonly assigned patent applications. The present invention retains the advantages of the methods disclosed in these patent applications, including the formation of cellulose-free insulation in situ while an electrical winding is being constructed on a mandrel or coil former at commercial winding speeds, while providing a substantially void-free winding structure which possesses, a higher and more uniform electrical breakdown strength, a greater mechanical strength, and improved thermal conductivity.

The present invention specifically relates to the formation of electrical windings constructed of wire or strap, as opposed to those formed of sheet or foil, and in particular to layer-type electrical windings having a plurality of conductor turn layers, with each layer having a plurality of conductor turns per layer.

The invention in its broadest aspect obtains the advantages of wet winding, i.e., the formation of a void-free structure while the insulation is still in a liquid stage, without the concomitant disadvantages of prior art wet winding procedures, i.e., uncontrolled voids in the insulation when the liquid insulation is solidified and advanced to final cure. Broadly, the method includes forming a plurality of conductor turns on a substrate, with the term "substrate", as used hereinafter, meaning any firm support sufficient to support a conductor turn, and it includes ground insulation, high-low insulation, a prior turn layer of the same or a different winding, and any prior applied solid layer of resinous insulation on any of the above. According to the method of the present invention, when the conductor turns are formed on a substrate, they are substantially immersed in liquid resinous insulation, as they are formed, to create a void-free intermediate structure. The method further includes building solid insulation, thin layer upon thin layer, on both the conductor turns which have already been formed, and the remaining substrate where additional turns are to be formed, with this building of solid insulation occurring simultaneously while conductor turns are being created. This method preserves the void-free aspect of the intermediate structure throughout all stages of the method, as the solid insulation, as it is formed, provides the substrate for subsequent conductor turns and, since the solid insulation is being built thin layer upon thin layer, the solid insulation retains the void-free aspect of the liquid insulation.

According to a preferred embodiment of the invention, a turn layer is constructed by applying a wire conductor to a substrate and adding conductor turns to the substrate in a predetermined axial direction. Liquid, radiation sensitive, resinous insulation is applied to the substrate, and also to the conductor turns as they are formed, with each new conductor turn "plowing" through the liquid resinous insulation on the substrate to provide a thin layer of liquid insulation between each conductor turn and the substrate, and to completely fill the spaces between adjacent conductor turns with the liquid resinous insulation. Periodically, as the conductor turns are being formed, excess liquid resin is removed from the conductor turns formed so far, and also from the remaining substrate upon which subsequent turns are to be formed, allowing a predetermined thin external layer of liquid insulation to remain on the conductor turns and on the remaining substrate. Each time such a thin layer of liquid insulation is formed, it is immediately solidified, i.e., the cure is advanced to a solid, non-tacky stage, such as by using a radiation sensitive liquid resinous insulation, and irradiating the liquid insulation with electromagnetic radiation, e.g., ultraviolet light. Liquid resin shielded by conductor turns will remain liquid or tacky, but the external thin layer on the surfaces of the conductor turns, the resin between the turns above the centers of the conductors, and also the resin on the remaining substrate, will solidify to a point capable of providing support for conductor turns subsequently applied thereto. The application of conductor turns to the substrate continues after each solidifying step, with liquid resin continuing to be applied to all of the conductor turns formed so far, and also over the last thin solidified layer of insulation on the substrate. This process of constructing the turn layer in sections continues, with the end of a section being signified by the solidifying step. As the conductor turns of each section are being wound into place, the conductor plows through the liquid insulation down to the support provided by the last solidified layer of insulation applied to the substrate. When the first turn layer is completed, this layer provides the substrate for the next turn layer, and its conductor turns are applied thereto in an axial direction opposite to that of the first turn layer. The process continues to provide additional turn layers, until the winding has been completed. A post cure, such as might be accomplished by heating the windings and insulation to a predetermined temperature for a predetermined period of time, advances both the partially cured solid insulation, and any still liquid or tacky insulation, to final cure. The still liquid or tacky insulation is an excellent adhesive, and even the solid insulation becomes tacky when heated as it proceeds to final cure, to bond the conductor turns tightly together in a mechanically strong, void-free mass of solid insulation which has a superior electrical strength due to the lack of voids, and a superior mechanical strength, as all of the conductor turns are essentially embedded in a solid insulation structure and not merely adhesively joined to other turns via line-contact type bonds. The solid structure also greatly promotes the transfer of heat from the conductor turns to the external surfaces of the solid insulation.

A winding formed in accordance with the invention has a much better space factor than a conventional cellulosic winding. The disclosed method makes possible a reduction of the conductor mean turn and of the overall winding dimensions, which reduces the size and weight of the magnetic core needed for the winding. The disclosed method also does away with costly bonding and drying operations of the windings, and it obviates oil impregnation problems since, contrary to conventional insulation systems employing cellulosic insulation, a winding formed in accordance with the invention needs no liquid dielectric for insulation purposes. Thus, the liquid in the transformer tank may be selected entirely for its cooling characteristics. All of the above lowers the manufacturing cost of a winding constructed according to the teachings of the invention, compared with manufacturing procedures of the prior art.

Another significant advantage derived from the invention is the electrical grading of the thickness of the insulation between adjacent turn layers of the winding. When an electrical winding is formed from wire wound helically about the winding axis, alternately back and forth between opposite winding ends to form consecutive concentrically adjacent layers of conductor turns, the dielectric stress from turn layer to turn layer is relatively low at the mutually connected ends of any two adjacent turn layers, and it gradually increases toward the mutually non-connected ends of such turn layers. With conventional winding structures having turn layers which are spaced apart uniformly over the complete length, i.e., axial dimension of the winding, the overall winding size is determined by the thickness which the insulation between turn layers must have in order to withstand the highest dielectric stress therebetween. In other words, it is determined by the thickness of the insulation required at the mutually non-connected ends of adjacent turn layers. The method of the present invention allows the total volume of the solid insulation, and thus, the total winding size to be substantially reduced, as the method inherently electrically grades the insulation during winding, i.e., it varies the thickness of the insulation between adjacent turn layers in accordance with the changing dielectric stress therebetween which will occur when the winding structure is electrically energized. Thus, when following the teachings of the invention, the solid insulation between adjacent turn layers will have a substantially wedge-shaped cross-sectional configuration, with substantially one-half of the solid insulation being built up, thin layer upon thin layer, as one turn layer is being formed, and the remaining insulation is applied, thin layer upon thin layer, as the next turn layer is being formed.

DESCRIPTION OF PREFERRED EMBODIMENTS

Figure 1:
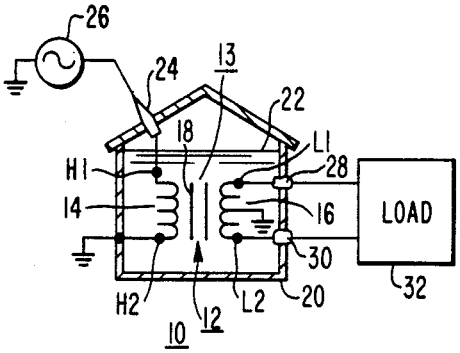
FIG. 1 is a schematic diagram of an electrical transformer having windings which may be constructed according to the teachings of the invention.

FIG. 1 is a schematic diagram of an exemplary distribution type transformer 10 having a winding, or windings, which may be constructed according to the new and improved methods of the invention. Transformer 10 includes a core-coil assembly 12 which includes a coil 13 comprising high and low voltage windings 14 and 16, respectively, disposed in inductive relation with a magnetic core 18. Assembly 12 is disposed in a tank 20, and it is immersed in a liquid cooling medium 22. Transformer oil may be used for the liquid cooling medium, but since the windings of the present invention do not require oil for electrical insulating purposes, other liquids selected primarily for their cooling characteristics may be used. The high voltage winding 14 is connected to a high voltage bushing 24 for energization by a source 26 of electrical potential, and the low voltage winding 16 is connected to low voltage bushings 28 and 30 for connection to a load 32.

Figure 2:
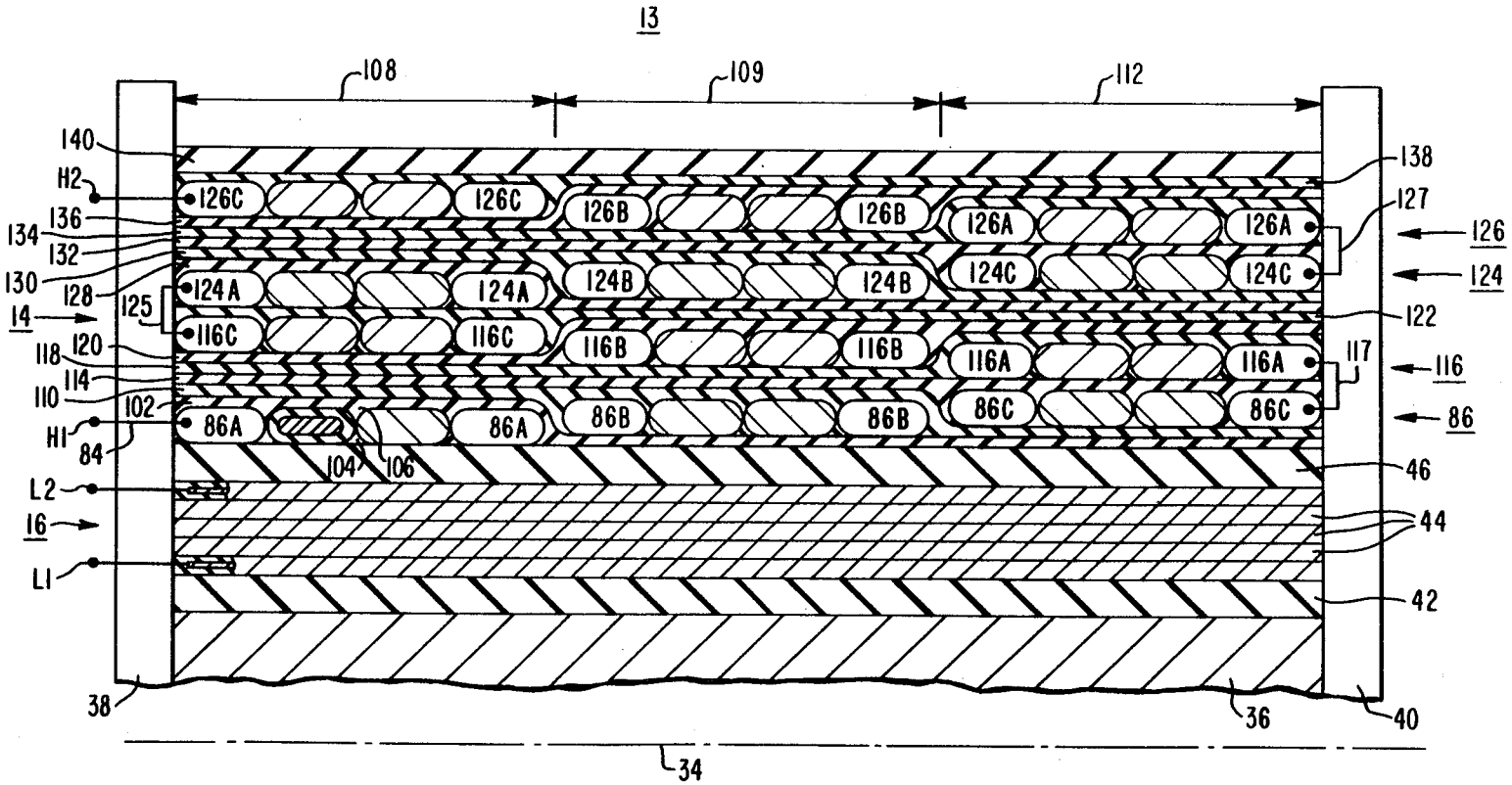
FIG. 2 is a partial sectional view of a transformer coil having a winding constructed according to the teachings of the invention.

FIG. 2 is a partial cross-sectional view of coil 13 shown schematically in FIG. 1, which is symmetrical about center line or axis 34. While each winding 14 and 16 of coil 13 may be constructed in sections, which are electrically connected together, only one section per winding is illustrated in FIG. 2 in order to simplify the drawing. Also, while it has been conventional for the low voltage winding 16 to be physically located next to the magnetic core 18, in the low-high (L-H) arrangement shown, or in a low-high-low (L-H-L) arrangement, it is to be understood that the high and low voltage windings may be in any desired order.

The present invention relates to a new and improved method of constructing a winding from wire having any desired cross-sectional configuration and dimensions, with the resulting winding having a plurality of conductor turns per turn layer, and a plurality of superposed, concentrically adjacent turn layers, as contrasted with a winding formed of sheet, strip or foil conductor, which would have a single turn per layer. The low voltage winding 16 may be constructed of sheet conductor, as illustrated, such as aluminum sheet insulated with a thin resinous layer of insulation on each side thereof, or it may be formed of wire commonly called strap. The high voltage winding 14 is illustrated as being constructed of flattened round wire, pre-insulated with a suitable insulating material such as enamel, but other cross-sectional configurations may be used, such as round or rectangular. FIG. 2 is a greatly enlarged view of the conductors of coil 13, and the layers of resinous insulation, in order to better illustrate the construction methods. Also, while the layers of insulation are illustrated as being discrete, this is only for purposes of illustration. In practice, when the liquid resinous insulation is applied in thin layers, as set forth in the teachings of the invention, the layers of insulation blend together into an indistinguishable mass of solid insulation, adding greatly to the high electrical breakdown strength of the winding structure.

Thus, for purposes of example, the invention will be described relative to the construction of the high voltage winding 14, since it is constructed of wire, and it will be described with reference to a rotatable mandrel or coil support 36, which may have flanges 38 and 40. It would also be suitable for the mandrel 36 to be stationary, with the supply stations rotating about the mandrel. The rotational axis of mandrel 36 is coaxial with center line 34 of coil 13.

Coil 13 requires ground wall insulation 42, which will be disposed between the innermost winding, i.e., the low voltage winding 16 in this example, and the magnetic core 18 (FIG. 1). The ground wall insulation may be provided by disposing a pre-manufactured winding tube on mandrel 36, or it may be built up of a plurality of thin layers of liquid insulation, with each layer of insulation being applied and instantly solidified before the next layer is applied, as described in detail in the hereinbefore-mentioned commonly assigned patent applications. The word "instantly" as used to describe the solidification of the resin refers to the quickness of the process, and does not mean that no time is required for the process. The actual time required for solidification is in the order of 1/20th to ½ second. If ground insulation 42 is formed in situ as mandrel 36 is rotated, it may be formed of the same liquid resin used to form the insulation for the high voltage winding 14, which will be hereinafter described. A suitable mold release material such as Teflon in spray form, may be sprayed on the mandrel 36 prior to building up the ground wall insulation 42. When the plurality of thin layers of solidified resinous insulation have been applied to achieve the desired thickness of ground wall insulation 42, low voltage winding 16 may be wound on insulation 42. However, as hereinbefore pointed out, insulation 42 may also form the substrate for constructing the high voltage winding 14, if desired. The low voltage winding 16 is formed of sheet conductor in this example, such as sheet aluminum having a thin, e.g., about 0.001 inch (0.0254 mm) thick layer of resinous insulation on each side thereof. Low voltage winding 16 has a plurality of layers 44, with each layer having a single turn. The resinous insulation on the sheet conductor has been advanced to a dry, non-tacky state, but the cure has not been advanced to final cure. This will be accomplished thermally in a suitable postcure operation after coil 13 has been completed. The post cure operation may be a separate heating step, such as by electrically energizing the windings, it may be accomplished when the windings are energized during load testing, or the post cure may take place during actual subsequent use of the electrical transformer 10. The resinous insulation passes through a tacky stage on its way to final cure, bonding the layers 44 tightly together. The insulation on the sheet conductors may be the same as the liquid resinous insulation used to construct the various insulating barriers of coil 13, such as the ground wall insulation 42, as well as the high voltage winding 14.

After the low voltage winding 14 has been wound, high-low insulation 46 is formed. In order to provide an essentially void-free structure, insulation 46 is preferably formed of a plurality of thin layers of liquid resinous insulation, each of which is solidified prior to application of a succeeding layer. Thus, this process may be similar to that of forming the ground wall insulation 42.

The inventive concept of wet winding conductor turns while simultaneously building up solid insulation from the same insulation into which the conductor turns are immersed, may be performed by many different methods. A preferred method of the invention will be described in detail, with FIGS. 3 and 4 setting forth apparatus 50 for performing this preferred method. Apparatus 50 includes the mandrel 36 shown in FIG. 2, which is driven by the head of a suitable winding machine 52, an applicator roller 54 driven by an adjustable speed drive 56, a supply 58 of liquid resinous insulation, a doctor blade 60, and a source 62 of radiation. Applicator roller 54 includes an elastomeric outer surface 64 having a predetermined resiliency selected to enable it to substantially conform to the variations in the surface to which it is applied. Rubber or polyurethane are suitable materials. Applicator roller 54 is driven at pre-programmed different rotational speeds throughout the method, and thus its driving means 56 is of the adjustable speed type.

The source 58 of liquid resinous insulation includes a container 66 and liquid resin 68. Liquid resin 68 is a cross-linkable, completely solventless resin capable of being quickly solidified, at least when applied in thin layers, by the source 62 of radiation. Resin 68 is also devoid of any filler which might shield and therefore slow the solidification process. The term "solidified" means that the curing of the resin has been advanced to a solid, non-tacky state, firm enough to support a conductor turn, but short of final cure. In other words, the radiation may advance the cure of the resin to what is sometimes referred to as the B-stage. Final cure may be accomplished thermally in a suitable post-curing step, as hereinbefore set forth. It is important that the resin becomes sufficiently hardened as it advances from the intermediate cure to a final cure, to ensure that it provides mechanical strength to maintain the integrity of the resulting structure. Liquid resin which is instantly solidifiable when subjected to an electron beam, or to electromagnetic radiation, such as infrared or ultraviolet light, may be used. A suitable resin for use in the methods of the invention, which meets all of the above-mentioned requirements, is disclosed in commonly-assigned application Ser. No. 433,324, filed Oct. 7, 1982, entitled, "UV Curable Composition and Coatings", now U.S. Pat. No. 4,481,258, and this application is hereby incorporated into the specification of the present application by reference. Thus, in the preferred embodiment of the invention, source 62 of radiation is a UV light source, such as the ultraviolet irradiators solid by Fusion System Corporation, Rockville, Md.

In the operation of apparatus 50, mandrel 36 is rotated in the direction of arrow 70, about rotational axis 34 and applicator roller 54 is rotated in the same circumferential direction as mandrel 36, as indicated by arrow 74, but at differential speeds, about a rotational axis 76 which is parallel with axis 34 and in a common plane. Applicator roller 54 is positioned such that a portion of its outer periphery rotates through the liquid resin 68. The viscosity of resin 68 is controlled to the desired range by resin formulation and temperature control, with the desired viscosity being that viscosity which will enable the liquid resin to flow and fill voids and pockets as it is applied, without running out of the pockets and voids at commercial winding speeds. A viscosity of about 5900 CP at 26° C., for example, has been found to be suitable. The doctor blade 60 is disposed adjacent to the side of roller 54 which rises out of the resin supply 58 with a new supply of liquid resin 68 thereon, and it is spaced from applicator roller 54 by a spacing 78 selected to meter and control the amount of resin carried by roller 54 to the mandrel 36 and coil 13 as it is being constructed. The position of roller 54 is controlled, such as by a pneumatic cylinder, to contact the outer periphery of coil 13 as it is being constructed, with the desired contact pressure. The doctor blade 60 regulates the amount of resin on the applicator roller 54 as it leaves the doctor blade. The applicator roller 54 and its rotational speed relative to the rotational speed of mandrel 36 regulate the amount and thickness of the liquid resin which is applied to the conductor turns and the remaining substrate of a turn layer.

A conductive strand 80, such as copper or aluminum wire suitably insulated with enamel 82, hereinafter referred to as wire 84, is used to construct the high voltage winding 14. Wire 84 may have any desired cross-sectional configuration, such as round or rectangular, with flattened round wire being excellent because of its good space factor. Flattening rolls for flattening round wire in-line as it proceeds to mandrel 36 may be provided, if desired. Wire 84 is placed in position on the insulative substrate, i.e., the high-low insulation 46 (FIG. 2) in the present example, and it is suitably secured adjacent one axial end of mandrel 36, such as adjacent to flange 38. The start of this conductor turn will be connected to a terminal H1, which may be connected to the conductive portion of bushing 24 and to the source 26 of electrical potential, as illustrated schematically in FIG. 1. Applicator roller 54 is positioned to contact the wire 84 and also the substrate, which as hereinbefore pointed out is the high-low insulation 46. The resiliency and contact pressure of the applicator roller 54 is selected such that the roller surface conforms both to the wire 84 and to the substrate to which the wire 84 is being applied. Apparatus 50 is now ready to wind a first turn layer 86 having a plurality of conductor turns. A typical high voltage winding for the distribution transformer may have about 100 turns per turn layer, and eight or ten turn layers, for example.

Applicator roller 54 applies liquid resin to the substrate and to each conductor turn as it is formed. Thus, the substrate upon which a conductor turn is being applied has liquid resin disposed on it, and each new turn "plows" through the liquid resin to the firm support provided by the substrate below. It is important at this stage of the method to have an adequate supply of liquid resin on the substrate. In this preferred embodiment of the invention, an adequate supply is obtained by providing more resin than will actually be used at any stage of the method, which excess resin being periodically removed, as will be hereinafter explained. A resin-rich substrate assures that each conductor turn will be completely immersed in liquid resin, to produce the desired void-free intermediate structure.

Figure 4:
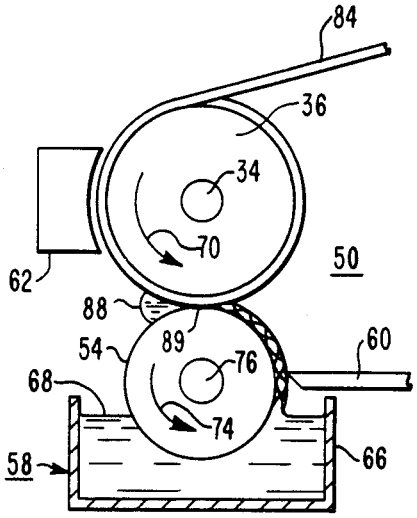
FIG. 4 is a vertical sectional view of the apparatus shown in FIG. 3, taken along a line IV—IV.
Figure 3:
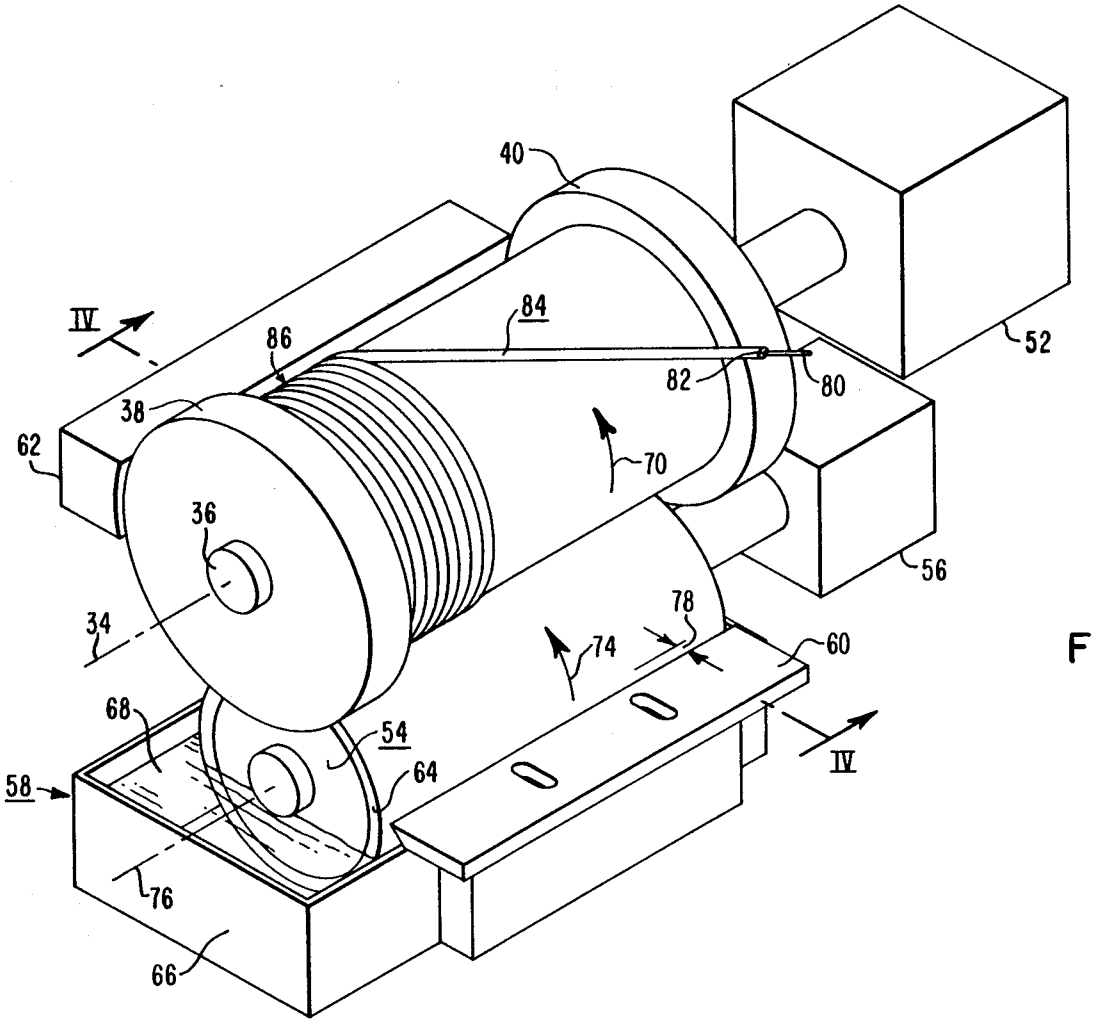
FIG. 3 is an isometric view schematically illustrating apparatus suitable for making the winding of FIG. 2 according to the methods of the invention.

FIG. 4 is a cross-sectional view of apparatus 50 shown in FIG. 3 illustrating how a "floating" reservoir of liquid resin is built up and maintained to assure sufficient resin for filling all spaces, gaps and voids of the winding as it is being constructed. With the doctor blade 60 adjusted such that its spacing 78 is about 0.020 inch (0.058 mm), the mandrel 36 and applicator roller 54 are rotated in the direction of arrows 70 and 74, respectively, with the applicator roller 54 having a relatively high initial rotational speed. For example, if the wire speed applied to the mandrel 36 is about 15 FPM, the peripheral speed of the applicator roller 54 may be about 15 FPM. At this relatively fast speed of applicator roller 54, a noticeable puddle 88 of liquid resin immediately forms at the nip between the applicator roller 54 and the substrate. When the puddle 88 is formed, a suitable reservoir of liquid resin is available to fill any size gap which may be formed between conductor turns, and the peripheral speed of applicator roller 54 is then reduced, such as to about 1 to 2 FPM, with the mandrel continuing to wind wire 84 at 15 FPM. This speed will now supply enough liquid resin to maintain puddle 88, without enlarging it to the point where it becomes a flood of resin.

Although in the preferred embodiment of the invention the relative directions of rotation of the mandrel 36 and applicator roller 54 are as shown by arrows 70 and 74 in FIGS. 3 and 4, it has been found that satisfactory operation may also be obtained when mandrel 36 is rotated in the opposite direction, which causes the puddle 88 to form on the opposite side of the nip 89 from that shown in FIG. 4.

Figure 5:
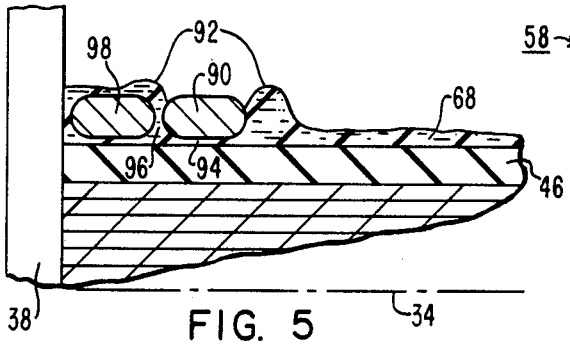
FIG. 5 is a partial sectional view showing the effect of winding conductor turns into liquid insulation.

FIG. 5 illustrates how the conductor, as each new conductor turn is formed, such as turn 90, plows through the liquid resin 68 on the substrate, raising furrows 92 of resin 68 as it displaces the liquid resin and descends upon the substrate 46 to be supported thereby, with a thin film 94 of liquid resin still remaining between the turn 90 and the solid substrate 46. This action also completely fills any space 96 between the just applied conductor turn 90 and the preceding conductor turn 98.

Figure 6:
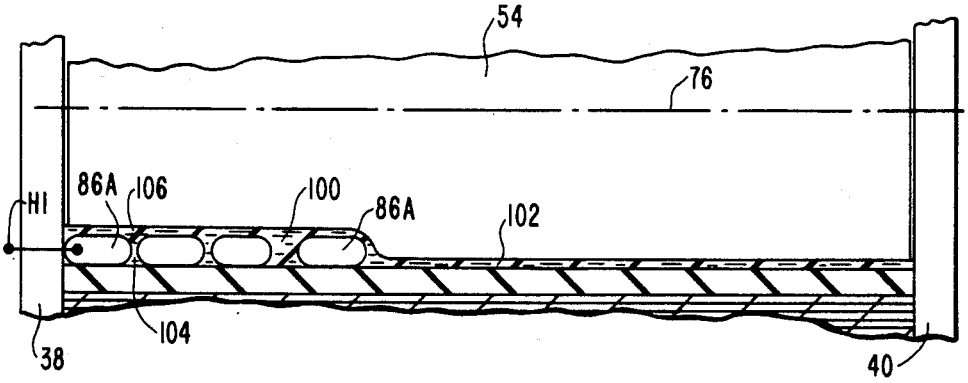
FIG. 6 is a partial sectional view showing how the applicator roller conforms to the conductor turns and to the unused substrate of a thin layer, while bridging small gaps between conductor turns.

After a predetermined number of conductor turns indicated in FIG. 2 generally as turns 86A have been applied to substrate 46 to form a first winding layer segment 108, the rotational speed of the applicator roller 54 is adjusted such that it no longer functions as a resin applicator, but as a resin remover. In other words, the rotational speed is reduced below that of the present speed, and in some instances, stopping the roller may achieve the desired results. In this new function, the applicator roller 54 squeezes the liquid resin from the surfaces of the conductor turns formed so far, as well as from the remaining substrate upon which subsequent conductor turns will be applied, with the roller 54 applying a pressure which forces liquid resin into all gaps and voids, if any still exist, with a very thin resin layer or film having a thickness of about 0.0005 to 0.003 inch (0.0125 to 0.0761 mm) remaining on the outer surfaces of the turns **86*a* and on the substrate 46. In a preferred embodiment, this layer or film has a thickness of about 0.001 inch (0.0254 mm). FIG. 6 illustrates how the uniform layer of liquid insulation is produced by the resilient surface of roller 54 conforming to the contour of the solid surfaces below it. It will be noted that uncommonly wide turn-to-turn gaps, such as gap 100, will be completely filled with resin, as applicator roller 54 will bridge gaps of this size. Before the uniform layer of liquid resinous insulation reaches puddle 88 (FIG. 4), source 62 is energized to irradiate the liquid layer of insulation, instantly solidifying the liquid insulation to create a solid layer 102. Source 62 is deenergized after one turn of the mandrel 36. It will be noted from FIG. 2 that solid layer 102 of insulation extends over the turns 86***a* formed so far, and also over the remaining substrate 46. This newly solidified layer 102 of resinous insulation now forms the substrate for the next conductor turns of layer 86. It should also be noted at this point in time that while layer 102 of resin is solid, that the conductor turns 86*a* have shielded certain portions of the resin, i.e., the resin located in the shadow of the turns, referenced 94 in FIG. 5. This portion of the resin continues to wet the interface between the conductor turns and solid substrate 46. Liquid resin between the turns, below the center lines of the conductors, may also be shielded if the conductor turns are closely packed, maintaining liquid, or at least tacky resin in such spaces, such as space 104 in FIGS. 2 and 6. The resin in the complementary space 106 between the turns, but above the center lines of the conductors, will be instantly solidified by the radiation.

The applicator roller 54 is immediately restarted as soon as the circumferential layer 102 of resin is solidified. The forming of conductor turns, which has never stopped, continues to add new conductor turns, which are now referred to as turns 86B. While conductor turns 85B are being formed, the applicator roller 54 continues to apply resin to all prior conductor turns formed, including turns 86A of the first segment and each new turn 86B, as well as to the remaining substrate, which is now defined by solid insulative layer 102. After the predetermined number of conductor turns 86B are formed, which form a second segment 109 of winding layer 86, the rotational speed of applicator roller 54 is adjusted to squeeze, evenly distribute, remove excess resin, and provide a uniform thin liquid coating of resin. This coating of resin is instantly solidified by radiation source 62 to provide a solid layer 110 of resin which extends over resin layer 102 disposed on the conductor turns 86A at the first segment 108, over the turns 86B of the second segment 109, and over solid resin layer 102 disposed on substrate 46.

The process of forming layer 86 of conductor turns in segments continues as hereinbefore described, with one more segment 112 being shown in FIG. 2, for purposes of example. Segment 112 includes conductor turns 86C with applicator roller 54 applying liquid resin to the turns of all prior segments, and to the turns 86C as they are formed. The squeezing action of roller 54 then forces resin into all of the cracks and voids which might exist about the conductor turns, it removes any excess resin, and it provides a thin layer of insulation on all conductor turns and the remaining substrate. The radiation source 62 is then energized to solidify the thin liquid layer of insulation, to provide a solid insulative layer 114 of resin which extends over the resinous layer 110 disposed on the first and second segments 108 and 109 of winding layer 86, and over the conductor turns 86C of the last segment 112. Solid insulative layer 114 now forms the substrate for the next winding layer 116.

Winding layer 116 applies conductor turns to substrate 114 in the axial direction opposite to the axial direction in which conductor turns were applied to form winding layer 86, with the same wire continuing from the finish end of turn layer 86, to the start of winding layer 116, as indicated by conductor 117, with these two ends being immediately adjacent to one another. When flanges 38 and 40 are used on mandrel 36, as illustrated in FIG. 2, as soon as flange 40 is encountered by the last turn of winding layer 86, the next conductor turn of wire 84 climbs above the last turn 86C to start conductor turns 116A of the next winding layer 116.

Winding layer 116 is also formed in segments, as described relative to the first winding layer 86. The first segment, which corresponds to the position of segment 112, includes a plurality of conductor turns 116A. The completion of segment 112 results in a solid thin insulative layer 118 of resin extends over conductor turns 116A, and also over the solid insulative layer 114, which functions as the substrate for winding layer 116. Completion of the next segment 109, which includes conductor turns 116B, results in a solid, thin insulative layer 120 which extends over the insulation layer 118 of segment 112, over conductor turns 116B of segment 109, and over the solid insulative layer 118 disposed on segment 108 of the remaining substrate. The remaining segment 108 is then formed, which includes conductor turns 116C, and the method of the invention results in a solid thin insulative layer 122 which extends over the insulative layer 120 of segments 112 and 109, and over conductor turns 116C of segment 108.

At this point, it will be noted that the method of the present invention automatically results in electrically grading the thickness of the insulation between turn layers 86 and 116. Thus, the layer insulation may be developed to have a thickness dimension, at any location, which is proportional to the magnitude of the electrical stress which will be developed between the winding layers when the high voltage winding 14 is energized. In the example of FIG. 2, a single solid insulative layer 114 separates the mutually connected ends of the turn layers 86 and 116, at the finish-start connection 117, and insulative layer 114 also separates the turns of the two layers 86 and 116 throughout segment 112 of the winding where the electrical stress is relatively low. Solid insulative layers 110, 114 and 118 separate conductor turns of adjacent winding layers 86 and 116 of segment 109, and solid insulative layers 102, 110, 114, 118 and 120 separate the turns of adjacent layers 86 and 116 in segment 108 where the electrical stress is the greatest. Thus, the solid resinous insulation disposed between adjacent turn layers is substantially wedge-shaped in cross-section. The desired thickness of the wedge-shaped solid insulation at any location between the axial ends of winding 14 is known for any specific winding, and the number of segments per turn layer is selected accordingly. For example, if 0.010 inch (0.254 mm) insulation layer thickness is desired between the unconnected ends of adjacent turn layers, and if the applicator roller 54 is adjusted such that a solid insulative layer having a thickness of about 0.001 inch (0.0254 mm) is provided after each segment, and if there are 100 conductor turns per winding layer, each winding layer would be divided into five segments having 20 conductor turns per segment. This would provide the desired insulation thickness at the unconnected ends, and it would electrically grade the thickness back to the mutually connected ends. If the desired thickness of insulation at the unconnected ends is much larger, such as 0.100 inch (2.54 mm), 50 segments having two conductor turns per segment would provide the desired thickness of insulation at the unconnected ends, and it would electrically grade the thickness of the layer insulation all the way back to the mutually connected ends of the winding layers.

The two turn layers 86 and 116 complete a basic grouping of an electrical winding constructed according to the teachings of the invention, with subsequent turn layers being constructed in a similar manner. For purposes of example, two additional turn layers are shown in FIG. 2, referenced 124 and 126, respectively, with turn layer 124 being constructed in a manner similar to turn layer 86, and turn layer 126 being constructed in a manner similar to turn layer 116. Insulative layer 122 forms the substrate upon which turn layer 124 starts, advancing from the finish end of turn layer 116 via finish-start connection 125. The turns 124A of segment 108 result in insulative layer 128 being formed, turns 124B of segment 109 result in the formation of insulative layer 130, and turns 124C of segment 112 resulting in insulative layer 132. It will be noted that the insulative layer between turn layers 116 and 124 is automatically electrically graded, with insulative layer 122 separating the turns of adjacent turn layers 116 and 124 in segment 108, insulative layers 120, 122 and 128 separating the conductor turns of the winding layers in segment 109, and insulative layers 118, 120, 122, 128 and 130 separating the conductor turns of the adjacent turn layers in segment 112. When turn layer 124 is completed, it continues to the start of turn layer 126 via finish-start connection 127, and turn layer 126 is formed in the same manner described relative to turn layer 116. The layer insulation between turn layers 124 and 126 is automatically electrically graded, with insulative layer 132 separating the conductor turns of the adjacent winding layers in segment 112, insulative layers 130, 132 and 134 separating the conductor turns of the adjacent turn layers in segment 109, and insulative layers 128, 130, 132, 134 and 136 separating the conductor turns of adjacent winding layers in segment 108.

After the last turn layer of the high voltage winding 14, together with a final insulative layer 138 has been completed, an insulative coating 140 may be formed thereon. The insulative coating 140 may provide the substrate for another section of the low voltage winding, if desired, or it may provide mechanical protection for coil 13 when the high voltage winding 14 is the outermost winding of coil 13. Insulative coating 140 may be built up of a plurality of thin layers of liquid insulation, in a manner similar to that described relative to the ground wall insulation 42, and the high-low insulation 46.

At this point in the formation of coil 13, the conductor turns of the high voltage winding 14 will be completely encapsulated in a void-free resinous insulation, with the resinous insulation being primarily solid, but still having liquid or tacky contact points between the conductor turns and the supporting substrate. Small pockets of tacky insulation in the radiation shielded area between adjacent conductor turns of each turn layer may also exist. These non-solid layers and pockets of resinous insulation, as well as the partially cured solid insulation, are now all advanced to final cure in which the resin is completely cross-linked or polymerized, in a post-cure operation which involves the application of heat. For example, coil 13 may be heated to the curing temperature of the resinous insulation used, for a specified length of time. Using the resin of the incorporated patent application, for example, the post cure step of the method may include heating coil 13 to 145° C.–150° C. and maintaining the temperature for about 4 hours. This may be accomplished by placing coil 13 in an oven, or by simply electrically energizing the windings and controlling the heat developed in the windings. The resinous insulation will also cure at lower temperatures over longer periods of time, and a specific post cure step may be omitted by simply allowing the final cure to take place gradually during other manufacturing procedures, such as load testing, and the energization of the coil 13 during actual use of the transformer in service. The void-free, cellulose-free winding construction of the present invention results in complete encapsulation of each conductor turn, with the solid insulation disposed about each conductor turn adhering tenaciously to the surface of the conductor turn. This results in achieving the ultimate electrical and mechanical strength, and it also achieves the ultimate in the loadability as heat developed in the conductor turns is rapidly transferred from the surface of the conductor turns to the outside surface of the coil, and thus to the cooling liquid 22 (FIG. 1) disposed about coil 13.

While the preferred embodiment of the invention is the embodiment hereinbefore set forth in detail, the invention broadly sets forth a wet-dry-wet process in which a conductor is wet wound such that conductor turns formed on a solid substrate are substantially immersed in liquid resinous insulation to create a void-free intermediate structure. The void-free aspect of the intermediate structure is preserved throughout the method by building solid insulation from the liquid resinous insulation, layer by layer, while the wet winding process continues, a method which precludes the formation of shrinkage voids which would deleteriously affect the electrical and mechanical strength, as well as impede the transfer of heat. The solid insulation, as it is formed on both the conductor turns and remaining substrate of each turn layer of the winding, provides a solid insulative substrate for subsequent conductor turns of the turn layer. In the preferred embodiment of the invention hereinbefore set forth, liquid resin is applied directly to a substrate, conductor turns are wound on the resin-rich, wet substrate, and liquid resin is forced to completely surround each conductor turn while any excess resin is squeezed from the winding to retain only a predetermined thin liquid resinous layer of predetermined thickness. This insulative layer is instantly solidified while the winding process continues, and liquid resin is applied to the solidified insulative layer to start another segment of the turn layer. In the preferred embodiment, the liquid resin is applied to all prior formed conductor turns, to the conductor turn being formed, and to the remaining substrate, as a continuous operation. The rotational speed of the applicator roller 54 is controlled differentially relative to the rotational speed of the winding mandrel, and in the preferred embodiment, the applicator roller remains in contact with a winding layer while it is being formed. It would also be within the scope of the broad aspects of the invention to apply sufficient liquid resin to the substrate, such as with an applicator roller, and then withdraw the applicator roller from the substrate. With the applicator roller spaced from the winding layer, all of the conductor turns of the next layer segment would be wound into the liquid resin applied to the substrate. Liquid resin would then be applied to the turns of the winding segment, and also to any prior turn segments, and the applicator roller would be reapplied to force the liquid insulation about the conductor turns formed while squeezing off any excess resin on the turns and the remaining substrate, to provide the predetermined thin insulative layer on both the conductor turns and the remaining substrate. The thin insulative liquid layer would then be solidified by the radiation source, and the applicator roller would again apply sufficient liquid resinous insulation to the applied conductor turns and remaining substrate. Again, the applicator roller would be withdrawn, all of the conductor turns of the next layer segment would be formed, etc.

Also, while the process described to this point has been made less critical and much easier to control by applying excess liquid resinous insulation to a substrate, and to the conductor turns, to provide a resin-rich substrate upon which the conductor turns are formed, the method includes a step which results in removing excess resin from the conductor turns and substrate. It is conceivable that by precisely metering the amount of liquid resin applied, that the step of forming the thin layer of liquid insulation would force all of the liquid resin to fill any remaining gaps and voids in the substrate, which would thus result in a process in which the step of removing excess resin would not be required.

Further, while the wet winding step of the preferred embodiment is accomplished by applying a dry conductor or wire to a substrate already rich with a liquid resin, i.e., the liquid resin is applied to the substrate via an applicator roller, it is conceivable and also within the scope of the broad aspect of the invention that the wet winding step may be performed by drawing the conductor through a liquid resin bath. Excess resin may be allowed to cling to the conductor, or the conductor with the liquid insulation thereon may be advanced through a metering orifice, as desired. Since an applicator roller of some sort would still be required, if electrically graded insulation is required, in order to apply liquid resin to the remaining substrate, and to the conductor turns of prior formed segments, the applicator roller might as well be used to apply all of the liquid resin, eliminating the step of drawing the conductor through a bath of liquid resin. Thus, the embodiment of the invention described in detail is preferred over this alternate embodiment.

In summary, there has been disclosed new and improved methods of constructing a cellulose-free, void-free electrical winding, using liquid resinous insulation, which achieves the ultimate in both electrical and mechanical strength, as well as providing excellent thermal conductivity. Each conductor turn of each winding layer is completely immersed in liquid resinous insulation during the process, and the liquid resinous insulation is periodically squeezed down upon the turns, to completely eliminate voids and force the liquid insulation to flow into all cracks and crevices of the winding structure. This creates a void-free intermediate structure, with the major portion of the liquid resinous insulation being immediately solidified in successive thin layers of insulation, to eliminate shrinkage voids and thus preserve the void-free aspect of the intermediate structure all the way to the final structure of the electrical winding. The solidified resin adheres tenaciously to the conductor turns, and it subsequently adhesive again when its cure is advanced to final and complete polymerization of the resin, to positively ensure that the resin is bonded to the conductor turns. During the post curing of the resin, a small amount of the resin passes directly from the wet, tacky form to a solid fully cured structure, i.e., the portion of the resin which was shielded from the radiation, with this occurrence positively ensuring a complete embedment of each turn in a solid, void-free mass of resinous insulation, to achieve the hereinbeforementioned ultimate in mechanical strength, sinch there are no partial bonds to weaken the structure. The ultimate in electrical strength is also achieved since there are no voids to ionize and degrade the surrounding insulation, and the thermal conductivity is excellent because the resulting structure is essentially void-free from the surface of each conductor turn to the outside surface of the associated winding. The disclosed methods also automatically electrically grade the thickness of the insulation disposed between adjacent turn layers of the winding according to the magnitude of the electrical stress which will be developed between the winding layers. This electrical grading of insulation reduces the physical winding size, compared with a winding structure in which a constant dimension is maintained between adjacent winding layers.

We claim as our invention:

1. A method of constructing an electrical winding insulated with solid resinous insulation, comprising the steps of:

forming conductor turns on a first substrate, said forming step including the step of wet winding a conductor upon said first substrate, said wet winding step substantially immersing each conductor turn in liquid resinous insulation, forming a liquid resinous interface between each conductor turn and said first substrate, to provide a void-free liquid intermediate insulative structure, and building solid insulation, layer upon layer, on the conductor turns and first substrate from the liquid resinous insulation, during the step of forming conductor turns, said building step including the step of controlling the thickness of said layers of solid insulation to eliminate shrinkage voids and preserve the void-free aspect of the liquid intermediate insulative structure, with said solid insulation, as it is formed, providing a second substrate upon which subsequent conductor turns may be formed.

2. The method of claim 1 wherein the forming step includes the step of applying liquid resinous insulation directly to the first substrate and to the conductor turns being formed on the first substrate.

3. The method of claim 1 wherein the forming step includes the step of continuously applying liquid resinous insulation directly to the first substrate and all conductor turns formed on the first substrate, including the conductor turn being formed.

4. A method of constructing an electrical winding insulated with solid resinous insulation, comprising the steps of:

forming conductor turns on a first substrate, said forming step including the step of wet winding a conductor upon said first substrate, with said wet winding step including the step of applying liquid resinous insulation directly to the first substrate and to the conductor turns being formed on the first substrate, said wet winding step substantially immersing each conductor turn in liquid resinous insulation to provide a void-free intermediate structure, and building solid insulation, layer upon layer, on the conductor turns and first substrate from the liquid resinous insulation, during the step of forming conductor turns, to eliminate shrinkage voids and preserve the void-free aspect of the intermediate structure, with said solid insulation, as it is formed, providing a second substrate upon which subsequent conductor turns may be formed, said step of building solid insulation including the steps of periodically forcing liquid resinous insulation about the conductor turns being formed on the first substrate to provide a substantially uniform layer of liquid resinous insulation of predetermined thickness on the conductor turns and remaining first substrate, and solidifying said layer of liquid insulation each time it is formed.

5. A method of constructing an electrical winding insulated with solid resinous insulation, comprising the steps of:

forming conductor turns on a first substrate, said forming step including the step of wet of winding a conductor upon said first substrate, with said wet winding step including the step of applying excess liquid resinous insulation directly to the first substrate, and to the conductor turns, said wet winding step substantially immersing each conductor turn in liquid resinous insulation to provide a void-free intermediate structure, and building solid insulation, layer upon layer, on the conductor turns and first substrate from the liquid resinous insulation, during the step of forming conductor turns, to eliminate shrinkage voids and preserve the void-free aspect of the intermediate structure, with said solid insulation, as it is formed, providing a second substrate upon which subsequent conductor turns may be formed, said step of building solid insulatiion including the steps of periodically forcing liquid resinous insulation about the conductor turns being formed on the first substrate, while removing excess resin, retaining sufficient liquid resin to provide a substantially uniform insulative liquid layer of resin having a predetermined thickness on the conductor turns and remaining first substrate, and solidifying said insulative layer each time it is formed.

6. A method of constructing an electrical winding insulated with solid resinous insulation, comprising the steps of:

forming conductor turns on a first substrate, said forming step including the step of wet winding a conductor upon said first substrate, with said wet winding step including the steps of applying liquid resinous insulation directly to the first substrate and conductor turns using a rotating applicator roller, and rotating the first substrate, said wet winding step substantially immersing each conductor turn in liquid resinous insulation to provide a void-free intermediate structure, and building solid insulation, layer upon layer, on the conductor turns and first substrate from the liquid resinous insulation, during the step of forming conductor turns, to eliminate shrinkage voids and pressive the void-free aspect of the intermediate structure, with said solid insulation, as it is formed, providing a second substrate upon which subsequent conductor turns may be formed, said step of building solid insulation including the steps of controlling the relative rotational speeds of the applicator roller and first substrate to periodically force liquid resinous insulation about the conductor turns formed so far, while providing a substantially uniform insulative layer of predetermined thickness on the conductor turns and remaining first substrate, and solidifying said insulative layer each time it is formed.

7. A method of constructing an electrical winding insulated with solid resinous insulation, comprising the steps of:

forming conductor turns on a first substrate, said forming step including the step of wet winding a conductor upon said first substrate, said wet winding step substantially immersing each conductor turn in liquid resinous insulation to provide a void-free intermediate structure, and building solid insulation, layer upon layer, on the conductor turns and first substrate from the liquid resinous insulation, during the step of forming conductor turns, to eliminate shrinkage voids and preserve the void-free aspect of the intermediate structure, with said solid insulation, as it is formed, providing a second substrate upon which subsequent conductor turns may be formed, said building step including the step of periodically providing thin insulative layers of liquid resinous insulation on the conductor turns formed so far and the remaining first substrate, irradiating the insulative layer each time it is formed, to solidify liquid resinous insulation not shielded by conductor turns including solidifying the insulative layer.

8. The method of claim 7 including the step of advancing to final cure the resinous insulation shielded by conductor turns, and the previously solidified resinous insulation.

9. The method of claim 8 wherein the advancing step includes the step of heating the resinous insulation.

10. The method of claim 6 including the step of controlling the relative rotational speeds of the applicator roller and first substrate to form a liquid puddle of resin at the nip between the rotating first substrate and rotating applicator roller which is of sufficient volume to completely fill in the spaces about the conductor turns.

11. The method of claim 1 wherein the step of forming conductor turns forms a plurality of turn layers, with the conductor turns of each turn layer being applied in an axial direction opposite to the preceding turn layer, and wherein the building step provides solid insulation between adjacent turn layers having an electrically graded thickness dimension.

12. A method of constructing a cellulose-free, void-free electrical winding having a plurality of layers of conductor turns, and a plurality of conductor turns per layer, comprising the steps of:

forming a first winding layer on a substrate, with said first winding layer having a plurality of conductor turns disposed about a central axis, said forming step including the steps of applying a conductor to the substrate and adding conductor turns thereto in a predetermined axial direction, applying liquid, radiation-sensitive resinous insulation to the substrate, and to the conductor turns as they are formed thereon, with each new conductor turn plowing through the liquid resinous insulation on the substrate to provide a thin layer of liquid resinous insulation between each conductor turn and the substrate, and to completely fill the spaces between adjacent conductor turns with liquid resinous insulation, periodically forcing liquid resinous insulation about the conductor turns formed so far, as the first layer of conductor turns is being formed, each time creating a predetermined thin external layer of liquid resinous insulation on the conductor turns formed so far and the remaining substrate, irradiating the predetermined thin layer of liquid resinous insulation each time it is periodically formed, to instantly solidify said predetermined layer and any liquid resinous insulation not shielded from the radiation by conductor turns, whereby the first winding layer is constructed in segments, with the conductor turns of each segment being wound on liquid resinous insulation, wherein they plow therethrough to the solid support provided by the last predetermined thin solidified layer of resinous insulation applied to the substrate, and forming additional winding layers, using each prior winding layer as the substrate for the next, by repeating the steps recited for the first winding layer.

13. The method of claim 12 including the step of heating the winding to solidify an liquid resinous insulation not solidified by the radiating steps.

14. The method of claim 12 wherein the step of applying the liquid resinous insulation includes the steps of applying a rotating applicator roller having liquid resinous insulation thereon to the conductor turns and remaining substrate, and forming a liquid puddle of resin at the resulting nip of sufficient volume to completely fill in the openings between the conductor turns of each layer of conductor turns as it is being formed.

15. The method of claim 14 wherein the forcing step also removes any excess liquid resinous insulation from the conductor turns and remaining substrate, with the forcing step including the step of slowing the rotational speed of the rotating applicator roller.

16. The method of claim 12 wherein the step of applying a conductor to the substrate reverses the axial direction of adding conductor turns from turn layer to turn layer, to build up the insulation between adjacent turn layers such that it has a substantially wedge-shaped cross-sectional configuration, with substantially one-half of the insulation being applied while one turn layer is being formed, and with the remaining portion of the wedge-shaped insulation being applied while the subsequent turn layer is being formed, grading the thickness of the wedge-shaped insulation according to the magnitude of the electrical stress which would be developed between adjacent turns of adjacent winding layers when the winding is electrically energized.

17. A method of constructing a cellulose-free electrical winding, comprising the steps of:

providing a substrate rich with liquid resinous insulation, winding a conductor on said substrate to construct a winding layer having a plurality of conductor turns, periodically removing liquid insulation during said winding step, applying liquid resinous insulation to the conductor turns formed so far, prior to each resin removing step, said resin removing step forcing liquid resinous insulation to flow about the conductor turns formed so far, removing any excess liquid resinous insulation from the conductor turns and remaining substrate, while forming an insulative layer of liquid resinous insulation of predetermined thickness on the conductor turns formed so far and remaining substrate, irradiating the insulative layer each time it is formed, instantly solidifying liquid resinous insulation not shielded by conductor turns, including the solidification of said insulative layer.

and applying liquid resinous insulation to the solidified insulative layer disposed on the remaining substrate, at least after each irradiating step, to enable said winding step to continue to form conductor turns on a surface rich with liquid resinous insulation.

* * * * *